US006930675B2

(12) United States Patent
Ishiyama

(10) Patent No.: US 6,930,675 B2
(45) Date of Patent: Aug. 16, 2005

(54) DISPLAY DRIVER, DISPLAY UNIT, AND ELECTRONIC INSTRUMENT

(75) Inventor: Hisanobu Ishiyama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 289 days.

(21) Appl. No.: 10/072,616

(22) Filed: Feb. 7, 2002

(65) Prior Publication Data

US 2002/0113781 A1 Aug. 22, 2002

(30) Foreign Application Priority Data

Feb. 22, 2001 (JP) ..... 2001-046595
Jan. 9, 2002 (JP) ..... 2002-002392

(51) Int. Cl.[7] ..... G09G 5/00

(52) U.S. Cl. ..... 345/204; 345/98; 345/99; 348/564; 348/565

(58) Field of Search ..... 345/204, 87, 98–100; 348/564, 565, 567

(56) References Cited

U.S. PATENT DOCUMENTS 5,530,797 A * 6/1996 Uya et al. ..... 345/532
6,115,017 A 9/2000 Mikami et al.
2002/0018058 A1 * 2/2002 Tamura ..... 345/204

FOREIGN PATENT DOCUMENTS

| | | |
|---|---|---|
| JP | 58-059494 | 4/1983 |
| JP | 08-076721 | 3/1996 |
| JP | 08-211849 | 8/1996 |
| JP | 09-281933 | 10/1997 |
| JP | 09-331490 | 12/1997 |

* cited by examiner

*Primary Examiner*—Jimmy H. Nguyen
(74) *Attorney, Agent, or Firm*—Hogan & Hartson, LLP

(57) ABSTRACT

A display driver, a display unit, and an electronic instrument that enables the simultaneous display of a still image and a moving image on the same scan line. An X driver IC includes at least display data RAM, in which is stored still-image data for one frame, and a line memory, in which is stored moving-image data for one scan line. A selector circuit selects one of still-image data for one scan line in the horizontal direction, which is read from the display data RAM, or moving-image data for one scan line, which is read from the line memory, based on image determination data, and outputs it as composite data of a still image and a moving image, for each column position. After the composite data has been latched by an output latch circuit, a liquid crystal panel is driven based on the latched data by a liquid crystal drive circuit.

14 Claims, 11 Drawing Sheets

| LINE DATA | COLUMN DATA | SELECTOR OUTPUT |
|---|---|---|
| H | H | MOVING-IMAGE DATA |
| H | L | STILL-IMAGE DATA |
| L | H | STILL-IMAGE DATA |
| L | L | STILL-IMAGE DATA |

DISPLAY DRIVER, DISPLAY UNIT, AND ELECTRONIC INSTRUMENT

Japanese Patent Application No. 2001-46595, filed on Feb. 2, 2001 and Japanese Patent Application No. 2002-2392, filed on Jan. 9, 2002 are hereby incorporated by reference in its entirety.

BACKGROUND

The present invention relates to a display driver, a display unit, and an electronic instrument.

Taking a mobile telephone as an example of an electronic instrument, a technique has been proposed for receiving or transmitting image data that has been compressed and encoded in accordance with the Moving Picture Experts Group (MPEG) standard. Such a technique makes it possible to display a moving image in a display area of a display section that is used for a still image in the art, by way of example.

In this example of a portable telephone, still-image data, which is a part of the image data to be displayed on the display section that involves a particularly light processing load, is generated by a central processing unit (CPU) that controls the portable telephone itself. The thus-generated still-image data is sent to a display data RAM and is read out in units of one scan line every frame period, by way of example. This reduces the processing load of the CPU and promotes a reduction in power consumption.

Moving-image data, on the other hand, involves processing that is large-scale and necessitates real-time capabilities, which means that a dedicated controller such as a digital signal processor (DSP) is provided separately from the CPU that has to handle processes such as the transfer of other data and the actual telephony, and the moving-image data is generated by that controller. The moving-image data could also be transferred to the above-described display data RAM, but it is possible to avoid complicating the circuitry required for simultaneous processing with the still-image data and also reduce the power consumption by using a one-scan-line memory that stores only data for one scan line.

SUMMARY

According to one aspect of the present invention, there is provided a display driver which drives a display section based on still-image data and moving-image data, the display driver comprising:

a randam access memory (RAM) from which still-image data is read out for each scan line;

a line memory in which is stored moving-image data in scan line units; and a selector which selects and outputs one of a scan line output from the RAM and a line memory output for each column position, based on image determination data.

DETAILED DESCRIPTION

Figure 1:
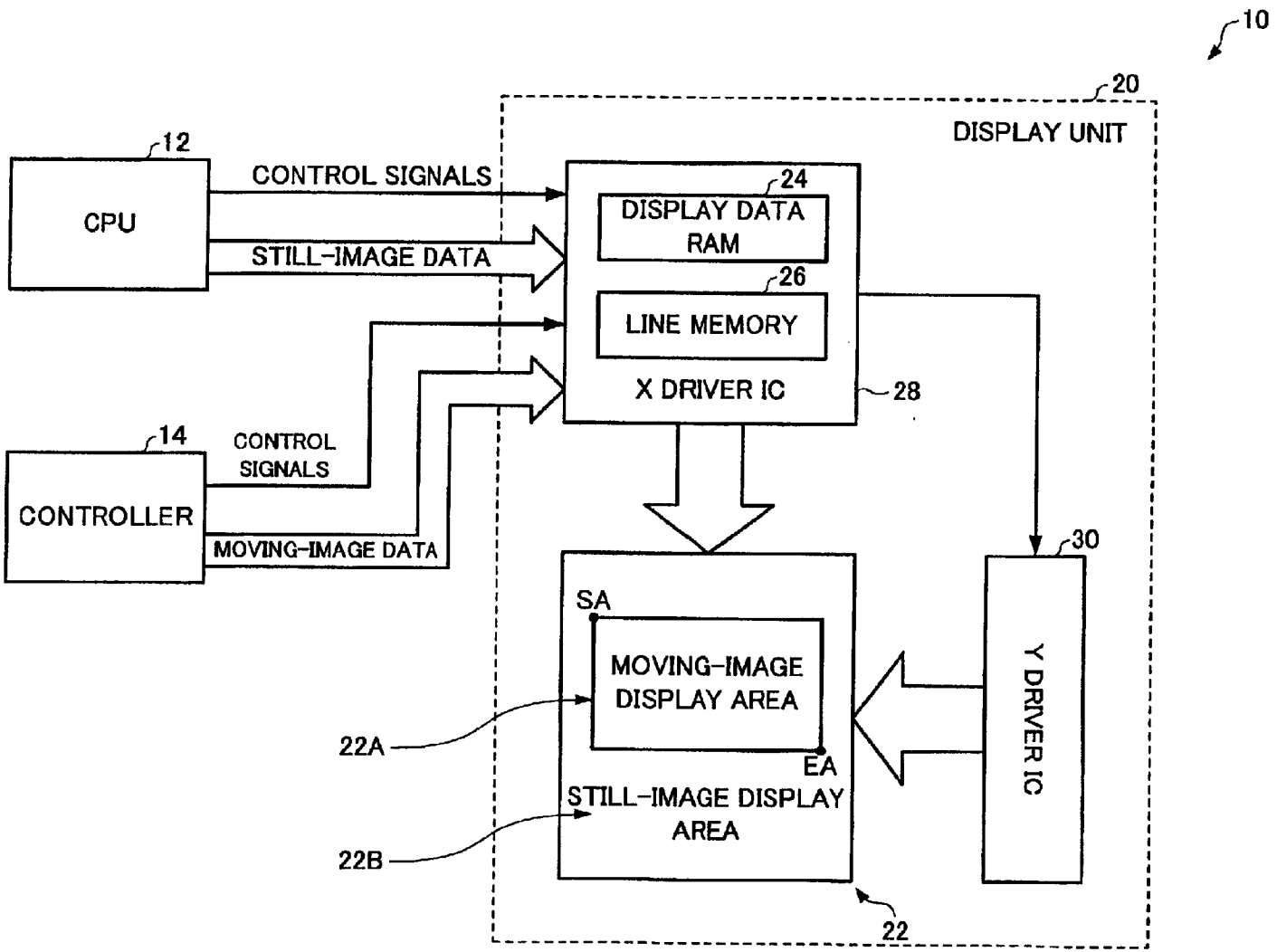
FIG. 1 is a schematic block diagram of an electronic instrument.

Embodiments of the present invention are described below.

Note that the embodiments described below do not in any way limit the scope of the invention defined by the claims laid out herein. Similarly, all the elements of the embodiments described below should not be taken as essential requirements of the present invention.

Various techniques for the simultaneous display of moving and still images have already been proposed, such as the "Matrix Panel Display Device" of Japanese Patent Application Laid-Open No. 8-76721 and the "Data Driver, and Liquid Crystal Display Device and Information Processing Device Using the Same" of Japanese Patent Application Laid-Open No. 9-281933, by which one of still-image data read from a display data RAM and moving-image data for one scan line is selectively output by switching signals for each scan line.

However, these techniques enable only the simultaneous display of still and moving images in units of one scan line. In other words, it is not possible to simultaneously display a still image and a moving image on the same scan line. For that reason, it is not possible to display moving-image data in a specific rectangular area within a display in which a still image is displayed such that still and moving images are simultaneously displayed on the same scan line.

The embodiments of the present invention were devised in the light of the above described technical problem and provide a display driver that can drive a display with still and moving images simultaneously displayed on the same scan line, with a reduced power consumption and without any complicated circuitry for the simultaneous processing of the still and moving images, together with a display unit and an electronic instrument using that display driver.

According to one embodiment of the present invention, there is provided a display driver which drives a display section based on still-image data and moving-image data, the display driver comprising:

a randam access memory (RAM) from which still-image data is read out for each scan line;

a line memory in which is stored moving-image data in scan line units; and a selector which selects and outputs one of a scan line output from the RAM and a line memory output for each column position, based on image determination data.

Note that the image determination data could be generated within the display driver, or it could be supplied from the exterior with other data such as still-image data.

This display driver has a line memory for storing moving-image data for each scan line. For each column position of each scan line in the display section, the display driver selects and outputs either still-image data read from the RAM or moving-image data read from the line memory, based on the image determination data. Therefore, still and moving images can be simultaneously displayed on the same scan line with a reduced power consumption and without any complicated circuitry for the simultaneous processing of still and moving images.

In this case, a scan line could be a line that is scanned in units of one pixel in the scan direction of the display section, or a line that is scanned in units of two or more pixels.

In this display driver, the image determination data may be generated based on: a column address for specifying a column position defining a display area that is driven on the basis of the moving-image data or the still-image data; and a line address for specifying a position of a scan line defining the display area.

In this case, the image determination data could be generated on the basis of column and line addresses within the display driver, or it could be image determination data that has been generated outside of the device on the basis of column and line addresses and is supplied to the display driver.

The display driver makes it possible to specify any area within an image display region based on the line and column addresses and display an image in which moving-image data and still-image data are provided on the same scan line thereof. It is therefore possible to display moving and still images simultaneously in any display area with a reduced power consumption.

In this display driver, the image determination data may be generated according to a column position defining a display area that is driven on the basis of the moving-image data or the still-image data, for each scan line.

The display driver can simultaneously display still and moving images by switching the image data in the column position based on the image determination data, for each scan line. Therefore, the dimensions of circuitry required for the simultaneous display can be greatly reduced and also implement a reduced power consumption.

The display driver may further comprise:

a line data register which stores line data indicating whether or not the display section is driven based on the moving-image data, at each scan line of one column;

a column data register which stores column data indicating whether or not the display section is driven based on the moving-image data, at each column position of one scan line; and an image determination data generation circuit which generates the image determination data based on the line data and the column data, for each column position of one scan line in the display section.

The display driver can simultaneously display the moving and still images for one frame, on the basis of only the line data and the column data.

In this display driver, the RAM may relate the image determination data that indicates whether or not the display section is to be driven on the basis of the moving-image data, with at least each column and store the image determination data; and the selector may select and output one of the scan line output from the RAM and the line memory output for each column position, based on the image determination data stored in the RAM.

Since the image determination data is linked to each column of the display data RAM and stored, it is possible to provide the scan line output and the line memory output on the same scan line.

In this display driver, the RAM may store the image determination data for each scan line; and the selector may select and output one of the scan line output from the RAM and the line memory output for each column position of each scan line, based on the image determination data stored in the RAM.

In this display driver, the RAM stores the image determination data for each scan line and the selector selects and outputs one of the RAM scan line output and the line memory output, for each column position of each scan line. Therefore, an image display area is not limited to a rectangular shape when moving and still images are simultaneously displayed. In such a case, since there is a tendency for the capacity of the display data RAM to increase with the increasing number of gray scale levels, there is substantially no effect on the circuit dimensions even when that image determination data is stored with linkages to each column.

According to one embodiment of the present invention, there is provided a display unit comprising:

a panel having electro-optical elements driven by a plurality of signal electrodes and a plurality of scan electrodes;

the above-described display driver for driving the plurality of signal electrodes; and a scan driver for driving the plurality of scan electrodes.

According to this display unit, the simultaneous display of moving and still images on the same scan line can be implemented with a reduced cost and power consumption and without increasing the dimensions of the circuitry.

An electronic instrument according to one embodiment of the present invention comprises: the above-described display unit, and an image data supply circuit which supplies the still-image data and the moving-image data to the display unit.

This electronic instrument enables the simultaneous provision of moving and still images on the same scan line during the simultaneous display of moving and still images by the display unit, and also enables a reduction in the cost and power consumption of the device.

Embodiments of the present invention are described in detail below with reference to the accompanying drawings.

1. First Embodiment

A first embodiment of the present invention is described below.

1.1 Electronic Instrument

A schematic block diagram of an electronic instrument to which the present invention is applied is shown in FIG. 1.

An electronic instrument 10 comprises a CPU 12, a controller 14, and a display unit 20.

The CPU 12 generates still-image data used for driving a display section of the display unit 20, in accordance with a program or firmware stored in memory such as RAM (not shown in the figure).

The controller 14 generates moving-image data that has been decoded by the MPEG standard, and the functions thereof are implemented by hardware such as an ASIC (gate array) or DSP, or by a program or firmware stored in RAM (not shown in the figure).

The display unit 20 comprises a matrix panel having electro-optical elements, such as a color liquid crystal panel 22, an X driver IC (generally speaking, a data driver; more generally speaking, a display driver) 28 containing a display data RAM 24 and a line memory 26, and a Y driver (generally speaking, a scan driver) 30 for scanning.

The liquid crystal panel 22 could use electro-optical elements such as a liquid crystal having optical characteristics that are changed by the application of a voltage. The liquid crystal panel 22 could be configured of a simple matrix panel, by way of example, in which case a liquid crystal is inserted between a first substrate on which is formed a plurality of segment electrodes (signal electrodes, or first electrodes) and a second substrate on which is formed common electrodes (scan electrodes, or second electrodes). The liquid crystal panel 22 could be an active matrix panel using 3-terminal or 2-terminal elements such as thin-film transistors (TFTs) or thin-film diodes (TFDs). Such an active matrix panel could also be provided with a plurality of signal electrodes (first electrodes) driven by the X driver IC 28 which contains the display data RAM 24 and the line memory 26, and a plurality of scan electrodes (second electrodes) driven by the Y driver IC 30.

Figure 12:
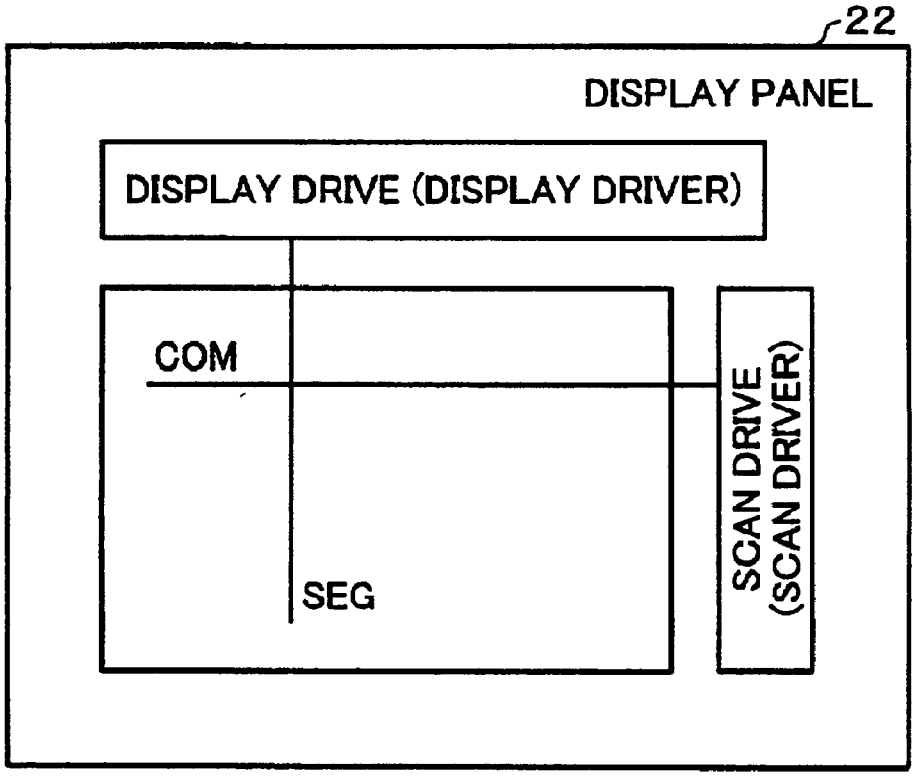
FIG. 12 is a diagram showing a liquid crystal panel formed on the same substrate on which the display driver is formed.

Note that a display drive circuit (generally speaking, a display driver), which is functionally equivalent to the X driver IC 28, may be formed on the glass substrate on which the liquid crystal panel (generally speaking, a display panel) 22 is formed, as shown in FIG. 12. In this case, the liquid crystal panel 22 may include electro-optical element driven by utilizing a plurality of signal electrodes and a plurality of a scan electrodes, and the above-described display drive circuit. A scan drive circuit, which is functionally equivalent to the Y driver 30, may also be formed on the glass substrate.

The thus-configured liquid crystal panel 22 is capable of simultaneously displaying a still image based on still-image data and a moving image based on moving-image data. In such a case, the liquid crystal panel 22 is provided with a moving-image display area 22A and a still-image display area 22B, as shown in FIG. 1.

The CPU 12 supplies display commands and still-image data for the X driver IC 28. For that reason, the CPU 12 supplies the X driver IC 28 with control signals such as an identification signal A0 for distinguishing between still-image data and display commands, an inverted reset signal XRES, an inverted chip select signal XCS, an inverted read signal XRD, and an inverted write signal XWR. During this time, data such as 8-bit data D7 to D0 is identified as being either still-image data or a display command by the logic of the identification signal A0. If still-image data has been supplied to the X driver IC 28 by data D7 to D0, that still-image data is stored in the display data RAM 24 in one-frame units.

The controller 14 supplies moving-image data to the X driver IC 28. For that reason, the controller 14 supplies the X driver IC 28 with control signals such as a write clock for writing the moving-image data, a writing vertical synchronization signal Vsync, and a writing horizontal synchronization signal Hsync. The moving-image data could be 6-bit R, G, and B signals, by way of example. This moving-image data is stored in the line memory 26 in units of one scan line.

The X driver IC 28 reads still-image data one scan line at a time from the display data RAM 24 and moving-image data one scan line at a time from the line memory 26, every given horizontal scan period of the display unit 20, and generates composite data formed of image data for the column positions of one scan line. The image data for each column position is obtained by selecting and outputting one of the still-image data and the moving-image data for each column position of each scan line, based on image determination data. The X driver IC 28 drives the liquid crystal panel 22, based on this composite data.

The image determination data is generated based on column addresses for specifying column positions defining a display area of the liquid crystal panel 22 and line addresses for specifying positions of scan lines defining the display area of the liquid crystal panel 22. This image determination data could also be generated by the X driver IC 28, or by the CPU 12 and the controller 14, by way of example.

Figure 2:
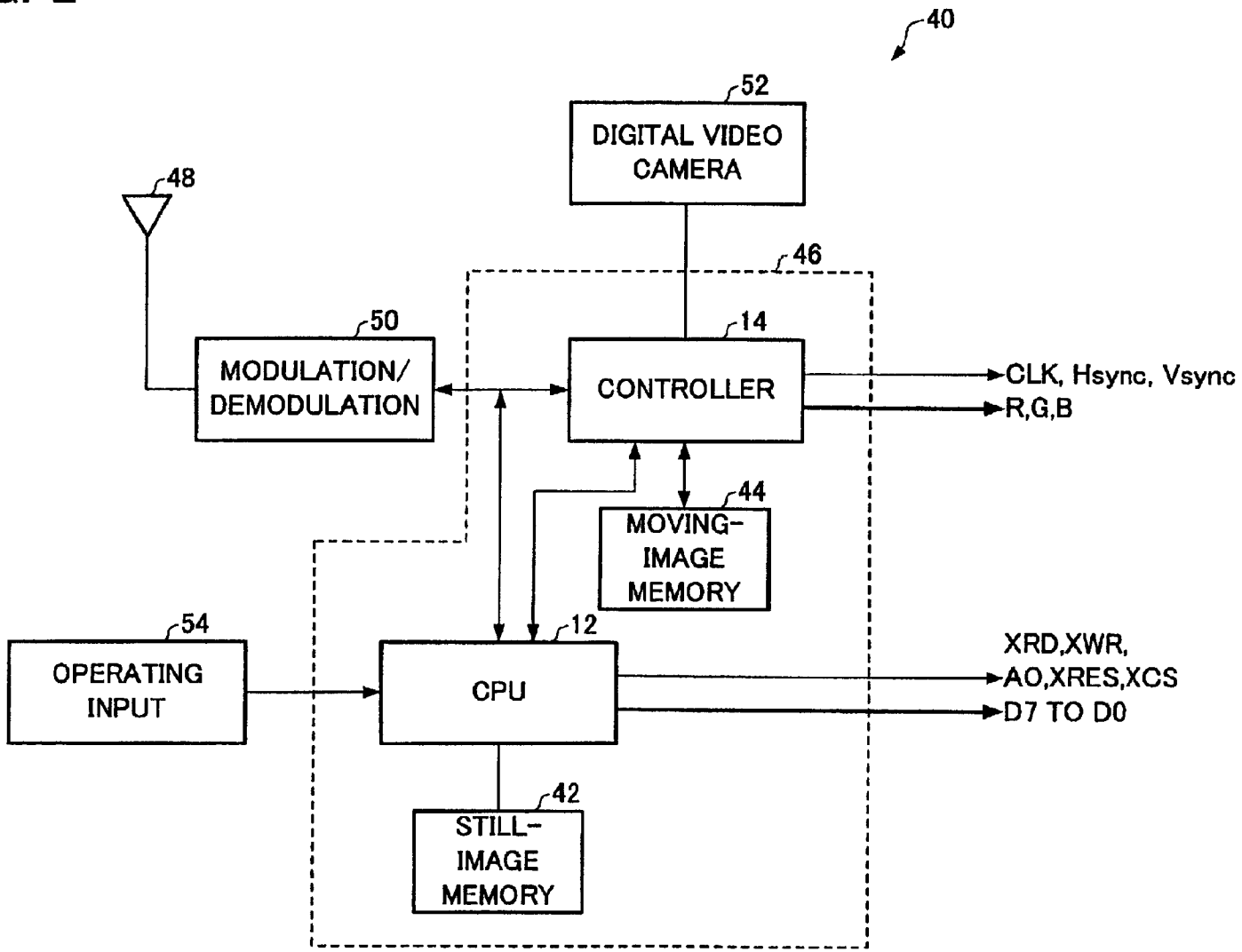
FIG. 2 is a diagram showing a portable telephone in which is installed the CPU and controller of FIG. 1.

An outline of the configuration of a portable telephone in which the CPU 12 and the controller 14 of FIG. 1 are installed is shown in FIG. 2.

This portable telephone (generally speaking, an electronic instrument) 40 has structural components controlled by the CPU 12. The CPU 12 is connected to a still-image memory 42 and the controller 14. A moving-image memory 44 is connected to the controller 14.

In this case, the CPU 12, the controller 14, the still-image memory 42, and the moving-image memory 44 could be configured as an MPU 46 that is integrated as a single chip. Programs for controlling the CPU 12 and the controller 14 could be stored in the still-image memory 42 and the moving-image memory 44.

The portable telephone 40 is provided with a modulation/demodulation circuit 50 for demodulating a signal that is received through an antenna 48, or modulating a signal that is to be transmitted through the antenna 48. It is also possible to transfer moving-image data that has been encoded in accordance with a standard such as MPEG, by way of example, from the antenna 48.

This portable telephone 40 can also be provided with a digital video camera 52, by way of example. Moving-image data can be obtained through this digital video camera 52. Operating information that is necessary for data transfer by the portable telephone 40 and the taking of images by the digital video camera 52 is input through an operating input section 54.

The CPU 12 determines the size of the moving image from moving-image information, during the display of that moving image in the moving-image display area 22A of the liquid crystal panel 22. A column address indicating a column position and a line address indicating a position of a scan line are set in the X driver IC 28 for each of a start address SA and an end address EA that specify the moving-image display area 22A of the liquid crystal panel 22. The X driver IC 28 generates composite data formed of image data for the column positions of one scan line. The image data for each column position is obtained by selecting and outputting one of the still-image data and the moving-image data for each column position of each scan line, based on those addresses.

A moving image displayed in the moving-image display area 22A is supplied from the antenna 48 or the digital video camera 52. A signal input from the antenna 48 is demodulated by the modulation/demodulation circuit 50 and is subjected to signal processing by the controller 14. The controller 14 is connected to the moving-image memory 44, it expands compressed data that has been input through the antenna 48 and the modulation/demodulation circuit 50, and it decodes data that has been encoded in accordance with the MPEG standard. The controller 14 compresses data to be transmitted through the modulation/demodulation circuit 50 and the antenna 48 and also encodes data to be sent in MPEG encoded form. This controller 14 has the function of acting as an MPEG decoder and encoder.

A signal could also be input to the controller 14 from the digital video camera 52, and signals that have been input from the antenna 48 or the digital video camera 52 are processed into RGB signals in the controller 14 and are supplied to the display unit 20.

The CPU 12 outputs to the display unit 20 the display commands and still-image data that are necessary for display of still images to be displayed on the liquid crystal panel 22, using the still-image memory 42 if necessary, based on information from the operating input section 54.

As an example, a movie trailer that has been distributed as movie information over the Internet is displayed in the moving-image display area 22A of the liquid crystal panel 22 and information concerning the reservations of tickets for that movie is displayed in the still-image display area 22B thereof. In such a case, the CPU 12 can control the modulation/demodulation circuit 50 and the antenna 48 and output ticket reservation requests input by the operating input section 54, enabling the user to reserve tickets for that movie.

1.2 Display Driver

Figure 3:
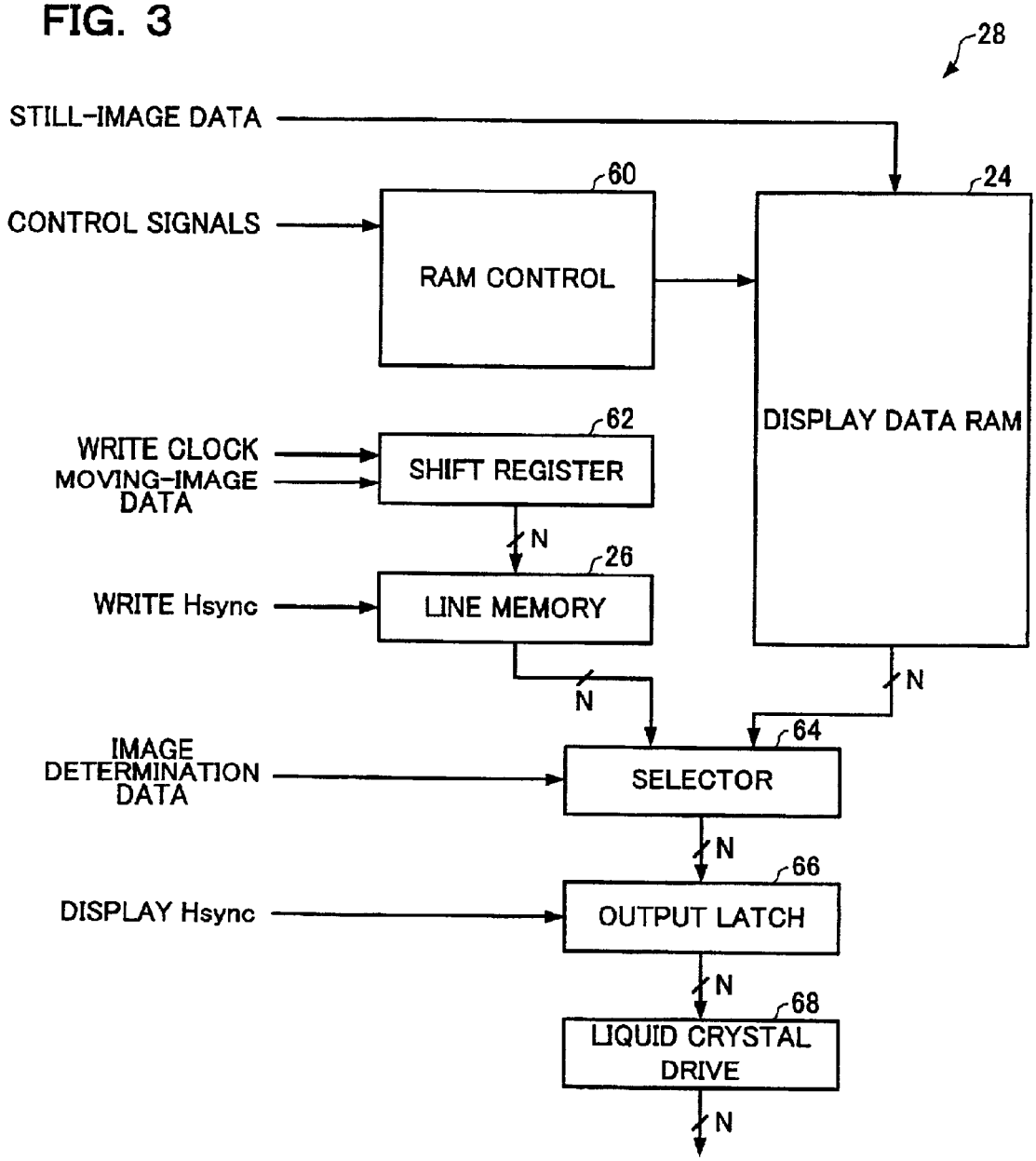
FIG. 3 is a diagram showing an X driver IC acting as a display driver of the first embodiment of the invention.

An outline of the configuration of the X driver IC 28 is shown in FIG. 3, as a display driver in accordance with the first embodiment of the present invention.

It should be noted that components that are the same as those of the X driver IC 28 of FIG. 1 are given the same reference numbers and further description thereof is omitted.

The X driver IC 28 of the first embodiment comprises at least the display data RAM 24 that stores still-image data for one frame and the line memory 26 that stores moving-image data one scan line.

The still-image data for at least one frame is written into the display data RAM 24 by a RAM control circuit 60, based on display commands (control signals) from the CPU 12. Still-image data for one frame is read out from the display data RAM 24 by the RAM control circuit 60, every given frame period of the display unit 20. The still-image data for one scan line of the liquid crystal panel 22 is read from the display data RAM 24, every horizontal scan period of the liquid crystal panel 22.

Moving-image data for one scan line of the liquid crystal panel 22 is written to the line memory 26. For that reason, the moving-image data for one scan line that is generated by the controller 14 is sequentially written to a shift register 62 in synchronization with the write clock that is input from the controller 14. If it is necessary to put N items of data into one scan line, the writing horizontal synchronization signal Hsync is input from the controller 14 every N clock cycles of the write clock, then N items of data are latched into the line memory 26 from the shift register 62.

A selector circuit 64 selects either still-image data that is read from the display data RAM 24 or moving-image data that is read from the line memory 26, for each column position, based on the image determination data, and outputs it as composite data of still-image and moving-image data.

Composite data for one scan line that has been selected and output from the selector circuit 64 is synchronized with a displaying horizontal synchronization signal Hsync of the display unit 20, and is latched into an output latch circuit 66.

A liquid crystal drive circuit 68 supplies the segment electrodes with drive voltages that have been shifted to correspond to the display voltage of the liquid crystal panel 22 of the display unit 20, based on the composite data latched by the output latch circuit 66.

Figure 4:
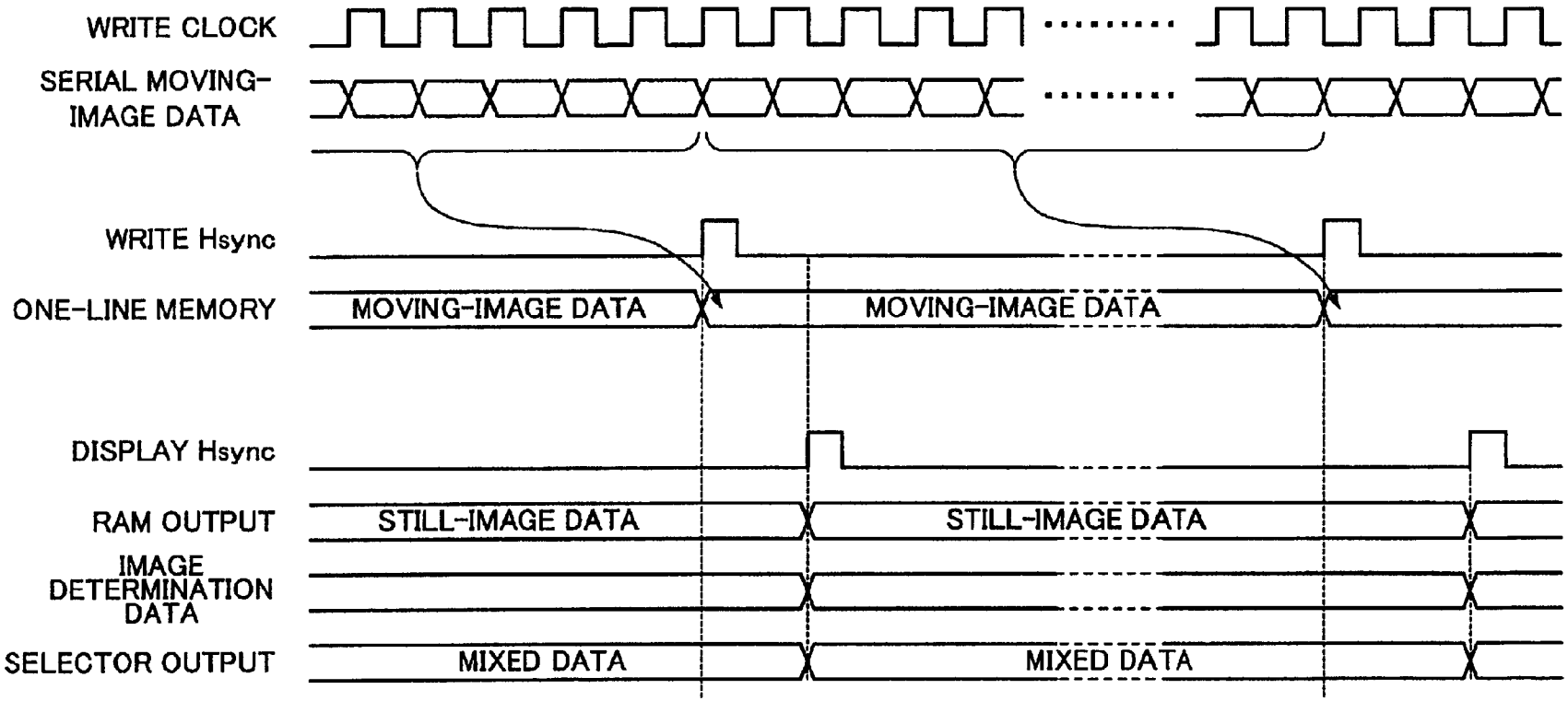
FIG. 4 is a timing chart showing an example of the operation of the X driver IC of FIG. 3.

An example of the operation of the X driver IC 28 of FIG. 3 is shown in FIG. 4.

In this case, assume that one frame of still-image data has been written to the display data RAM 24 from the CPU 12, by a display command.

The moving-image data that has been transferred serially from the controller 14 in synchronization with the write clock is written sequentially to the shift register 62. The controller 14 generates the writing horizontal synchronization signal Hsync every N write clock cycles. The N items of serially transferred moving-image data that have been written to the shift register 62 are written to the line memory 26 in synchronization with the writing horizontal synchronization signal Hsync.

The display unit 20 is driven on the basis of the image data every given frame period generated by a display timing control circuit (not shown in the figure). For that purpose, still-image data is read for each scan line from the display data RAM 24 by the RAM control circuit 60, every frame period.

The image determination data indicates which of still-image data or moving-image data is to be selected and output for each column position of each scan line every frame period. The selector circuit 64 selects only one of still-image data to be read out from the display data RAM 24 and moving-image data to be read out from the line memory 26, for each column position, based on this image determination data, as a selector output.

1.3 Image Determination Data

Determination by Address

The generation of this image determination data is based on column and line addresses that specify the display area of the liquid crystal panel 22 of the display unit 20, by way of example.

Figure 5:
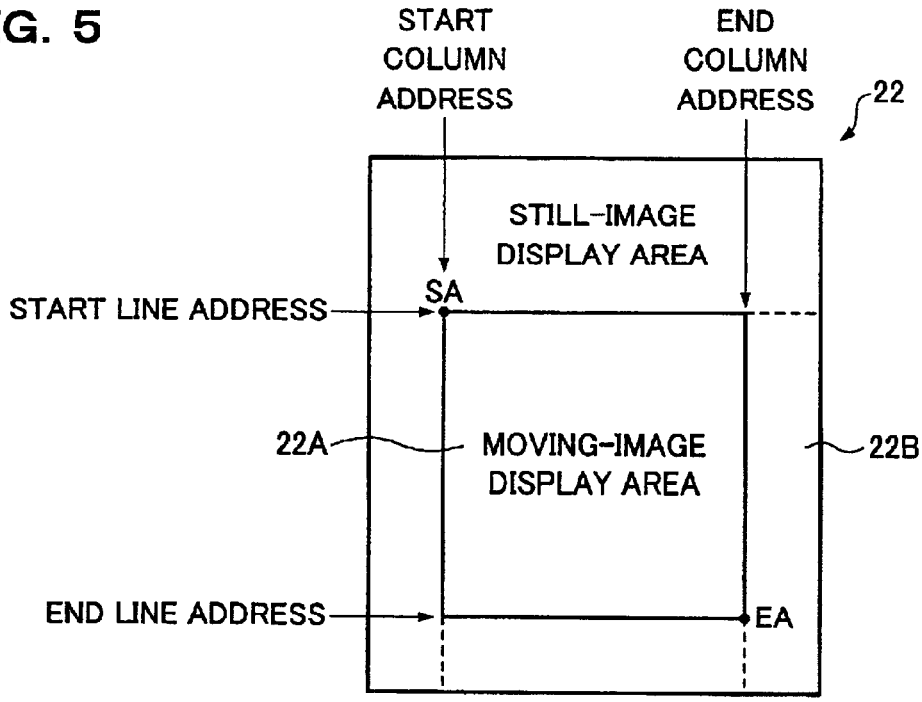
FIG. 5 is illustrative of column and line addresses of the liquid crystal panel.

An illustrative view of column and line addresses of the liquid crystal panel 22 is shown in FIG. 5.

If the moving-image display area 22A is provided in a rectangular area in the still-image display area 22B of the liquid crystal panel 22, the start address SA and the end address EA is set therefor. In other words, the moving-image display area 22A is specified by the start address SA and the end address EA. These start address SA and end address EA are set by the CPU 12 with respect to the X driver IC 28.

The start address SA is defined by a start line address and a start column address. The end address EA is defined by an end line address and an end column address.

In the liquid crystal panel 22, the display for one frame is started in synchronization with a displaying vertical synchronization signal Vsync, and the liquid crystal panel 22 is driven in one scan line units in synchronization with the displaying horizontal synchronization signal Hsync.

In this case, the CPU 12 can determine for each column position of each scan line whether an area to be displayed is part of a still-image display area or a moving-image display area, from a line address that specifies each scan line updated by the displaying horizontal synchronization signal Hsync and a column address that specifies each column position of each scan line.

If the entire display area has been set as the still-image display area, by way of example, it is possible to determine that the start line address of the start address SA and the end line address of the end address EA defines the moving-image display area in the line direction. Similarly, it is possible to determine that the start column address of the start address SA and the end column address of the end address EA in the column direction defines the moving-image display area in the column direction. These determination results are supplied as image determination data to the selector circuit 64 in synchronization with the displaying horizontal synchronization signal Hsync.

Alternatively, this determination could be done by the controller 14 based on the start address SA and the end address EA set by the CPU 12, in synchronization with the writing horizontal synchronization signal, the moving-image display area that has been set by the CPU 12, and the result is supplied to the X driver IC 28 together with the moving-image data that is transferred in units of one scan line. In that case, the X driver IC 28 could have only to select and output one of the still-image data and the moving-image data in units of one scan line, based on that determination result transferred thereto.

Note that the moving-image display area 22A is set within the area of the still-image display area 22B in this case, but a similar determination is equally possible if the still-image display area 22B is placed within the area of the moving-image display area 22A.

Determination by Data

The generation of the image determination data of the first embodiment of the present invention is not limited to a basis on line and column addresses, as described above. It is equally possible to set 1-bit image determination data that indicates whether a still image or a moving image is to be displayed beforehand as respective line and column data, and base the generation on that line and column data. This makes is possible to greatly reduce the circuit dimensions and also enables a further reduction in power consumption, in comparison with the case described above.

Column data is data that indicates whether a still image or a moving image is to be displayed at each column position of each scan line. Line data is data that indicates whether a still image or a moving image is to be displayed at each scan line position of each column.

Figure 6:
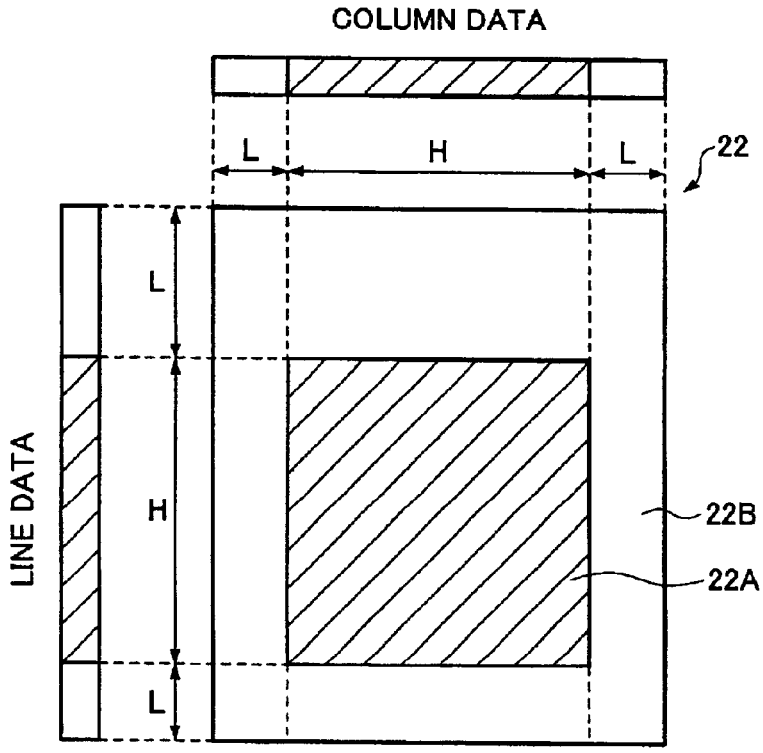
FIG. 6 is illustrative of line and column data for the liquid crystal panel.

A illustrative view of line and column data of the liquid crystal panel 22 is shown in FIG. 6.

If it is assumed that the logic level is low (L) for the display of a still image and high (H) for the display of a moving image in this case, the column data could be "LL . . . LHH . . . HL . . . LL" that indicates the display of either a moving image or a still image at each column position of one scan line, for example. If each column position of one scan line has only still-image data, for example, the column data is "LL . . . LL", whereas if each column position of one scan line has only moving-image data, the column data is "HH . . . HH".

Similarly, the line data could be "LL . . . LHH . . . HL . . . LL" that indicates the display of either a moving image or a still image at each scan line of one column position, for example. If each scan line at one column position has only still-image data, by way of example, the line data is "LL . . . LL", whereas if each scan line at one column position has only moving-image data, the line data is "HH . . . HH".

Figures 7A, 7B:
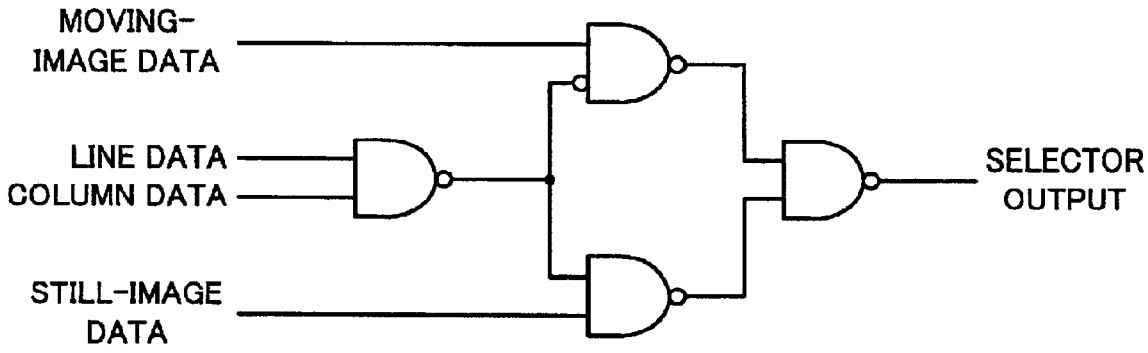
FIG. 7A is a truth table for the generation of composite data from line data and column data and FIG. 7B is a circuit diagram of a specific example of a structure for generating composite data based on line data and column data.

A truth table for generating composite data from this column data and line data is shown in FIG. 7A. A specific circuit structural example for the generation of composite data from line data and column data is shown in FIG. 7B.

In other words, an area in which both the line data and the logic level of the column data are high becomes the moving-image display area 22A, as shown in FIGS. 6 and 7A.

In this case, if the logic levels of both the line data and the column data are high, image determination data is generated in such a manner that moving-image data is selected for output, as shown in FIG. 7B.

Figure 8:
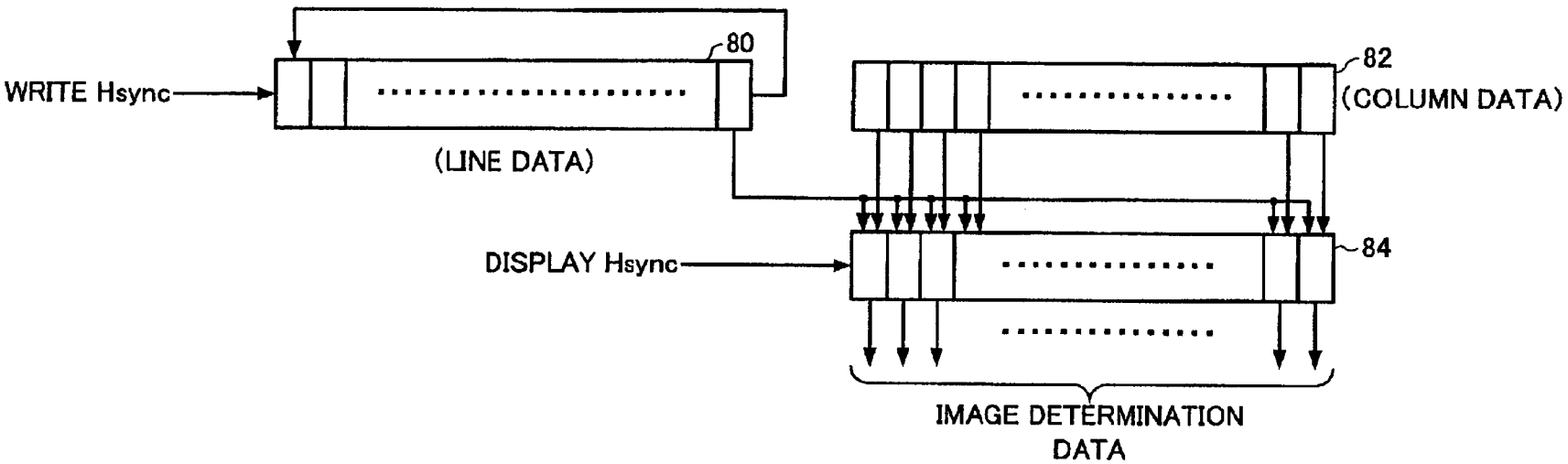
FIG. 8 is illustrative of the configuration of an image determination data generation circuit that generates image determination data in the first embodiment.

An example of the configuration of an image determination data generation circuit that generates the above-described image determination data is shown in FIG. 8.

The image determination data generation circuit comprises a line data register 80 in which is stored the above described line data, a column data register 82 in which is stored the above described column data, and a data generation circuit 84 provided for each column position of one scan line, to generate the image determination data.

The line data register 80 shifts the line data one bit sequentially, starting from the first scan line of the liquid crystal panel 22 in the scan direction, in synchronization with the writing horizontal synchronization signal Hsync. This shift output is supplied to the data generation circuit 84 that is provided for each column position of one scan line.

The column data register 82 outputs the column data indicating whether a still image or a moving image is to be output at each column position of one scan line, in synchronization with the displaying horizontal synchronization signal Hsync. Each bit of the column data is supplied to the corresponding data generation circuit 84 provided for each column position.

The data generation circuit 84 generates the image determination data for each column position, based on the 1-bit output from the line data register 80 and the column data for each column in the column data register 82 in synchronization with the displaying horizontal synchronization signal Hsync, in such a manner that moving-image data is selected for output when the logic levels of both the column data and the line data are high, as shown in FIG. 7A.

In such a manner, the simultaneous display of still and moving images in any rectangular area within the display area for one frame is enabled by the column data and line data. It is also possible to greatly reduce the circuit dimensions, enabling a further reduction of power consumption.

Note that the above data generation circuit could supply the image determination data to the X driver IC 28 together with the moving-image data in units of one scan line, in synchronization with the writing horizontal synchronization signal. In addition, the controller 14 could also generate the above-described line data and the column data based on the start address SA and the end address EA set by the CPU 12. In either case, the X driver IC 28 has only to select and output one of the still-image data and the moving-image data for each scan line, based on the transferred image determination data.

The thus-configured X driver IC 28 of this first embodiment of the invention makes it possible to display moving and still images on the same scan line, without complicating the circuit structure and with a low power consumption. This also makes it possible to separate the controller for generating the moving-image data completely from the CPU for still images, enabling distributed processing and reduction of the load on the CPU.

1.4 Structural Example of X Driver IC

A detailed example of the structure of the X driver IC 28 described above is shown in FIG. 9.

This X driver IC 28 is provided with a CPU interface 100, an input-output buffer 102, and an input buffer 104 as input-output circuitry.

Signals such as the inverted chip select signal XCS, the command/data identification signal A0, the inverted read signal XRD, the inverted write signal XWR, and the inverted reset signal XRES are input to the CPU interface 100. Data such as 8-bit display commands or still-image data D7 to D0 is input to the input-output buffer 102. Note that in this case the data D7 to D0 is input and output in parallel, but if it is not necessary to read data from the display data RAM within the X driver IC 28 to the CPU 12, the data could be input and output in series with the first bit being the identification signal A0, followed by the bits of data D7 to D0. In that case, it is possible to reduce the number of terminals of the CPU 12 and the X driver IC 28 relating to the driving of the display section.

Moving-image data that consists of 6-bit R, G, and B signals, by way of example, and a clock signal CLK are input to the input buffer 104. The 6-bit R, G, and B signals are input in parallel, in synchronization with the clock signal CLK.

The X driver IC 28 is provided with a first bus line 110 connected to the CPU interface 100 and the input-output buffer 102 and a second bus line 120 connected to the input buffer 104.

A bus holder 112 and a command decoder 114 are connected to the first bus line 110 and another bus holder 122 is connected to the second bus line 120. Note that a status setting circuit 116 is connected to the input-output buffer 102, with the configuration thereof being such that the operating state of the X driver IC 28 is output to the CPU 12. This operating state is an internal state that is set by the X driver IC 28 such as whether or not the display is in an on state and whether or not a given scroll area on the screen is in a scroll mode. This operating state is output by the X driver IC 28 after a given command that is input from the CPU 12 is decoded by the comman decoder 114.

The first bus line 110 is connected to an I/O buffer 162 of the display data RAM 24 for the transfer of still-image data to be read from or written to the display data RAM 24.

The second bus line 120 is connected to the line memory 26 for the transfer of moving-image data to be written in scan line units into this line memory 26.

In addition to the above-described display data RAM 24, I/O buffer 162, and line memory 26, the X driver IC 28 is provided with components such as a CPU-system control circuit 130, a column address control circuit 140, a page address control circuit 150, a driver-system control circuit 170, a selector circuit 180, a PWM decoder circuit 190, and the liquid crystal drive circuit 68.

The CPU-system control circuit 130 controls read and write operations with respect to the display data RAM 24, based on display commands of the CPU 12 that are input through the command decoder 114. The column address control circuit 140 and the page address control circuit 150 that are controlled by this CPU-system control circuit 130 are also provided. The reading/writing destination of the display data RAM 24 is specified by a column address indicated by the column address control circuit 140 and a page address indicated by the page address control circuit 150.

Figure 9:
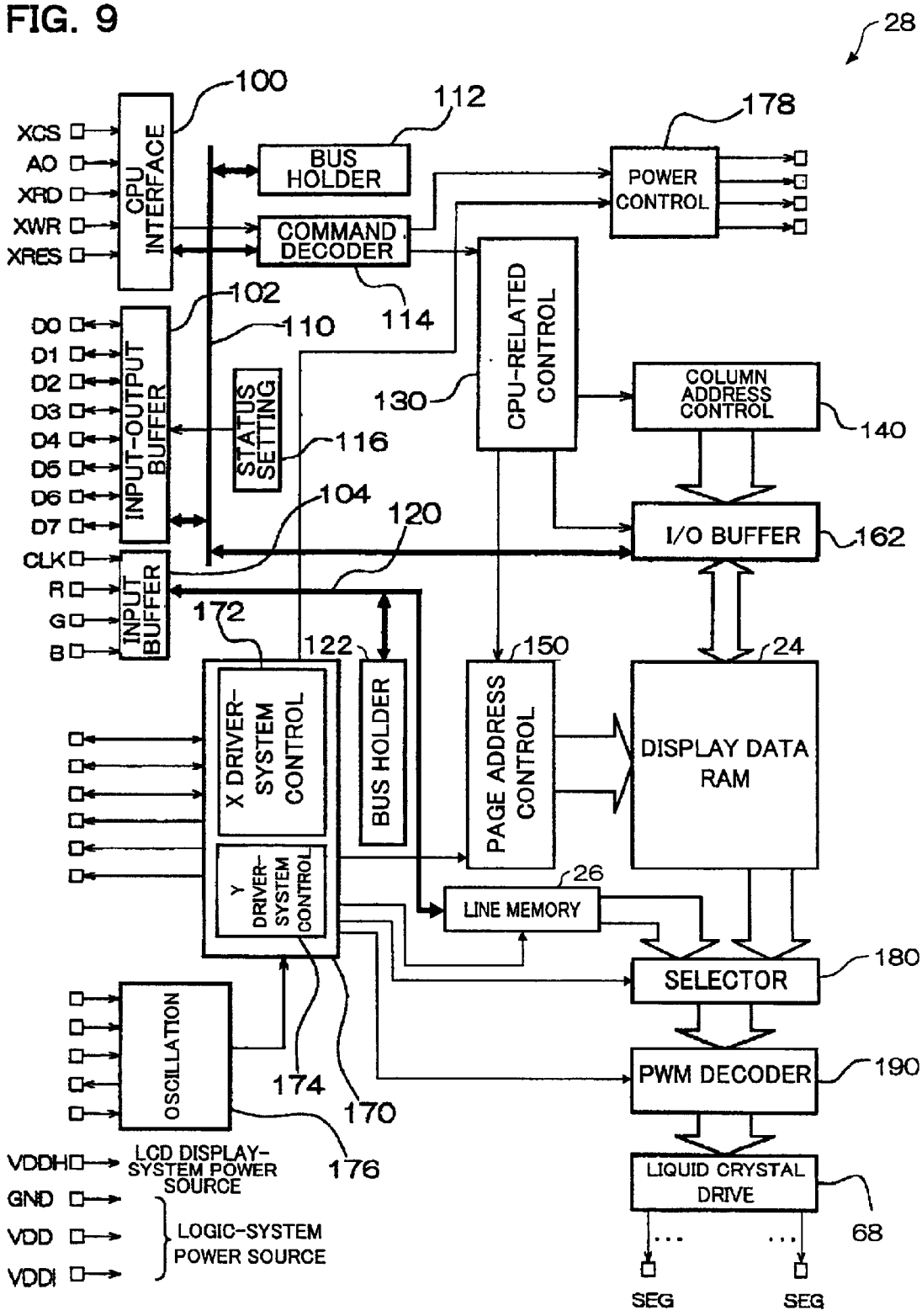
FIG. 9 is a block diagram of details of the block structure of the X driver IC of this first embodiment.

Note that the writing horizontal and vertical synchronization signals Hsync and Vsync from the CPU 12 are input to the CPU-system control circuit 130, although this is not shown in FIG. 9. The writing horizontal synchronization signal Hsync is used to set and reset counters within the column address control circuit 140 and the page address control circuit 150, to suppress any problems such as display slippage due to erroneous write by noise or the like during the writing of moving-image data, as far as possible. In addition, the writing horizontal and vertical synchronization signals Hsync and Vsync are used for returning the column address and the page address to the start address SA.

The driver-system control circuit 170 comprises an X-driver-system control circuit 172 and a Y-driver-system control circuit 174. This driver-system control circuit 170 generates signals such as the displaying vertical synchronization signal Vsync, a gray scale control pulse GCP, a polarity inversion signal FR, a scanning latch pulse LP, a Y driver start pulse YD, a Y driver scan clock YCLK, and the write clock to the display data RAM 24, based on an oscillation output from an oscillation circuit 176, to control the selector circuit 180, a PWM decoder circuit 190, a power control circuit 178, and the Y driver IC 30, independently of the CPU-system control circuit 130.

The driver-system control circuit 170 of this first embodiment of the invention outputs to the exterior the displaying vertical synchronization signal Vsync that is generated on the basis of the oscillation output from the oscillation circuit 176. The controller 14 supplies the generated moving-image data to the X driver IC 28 in synchronization with the displaying vertical synchronization signal Vsync.

The driver-system control circuit 170 writes the supplied moving-image data to the line memory 26 in synchronization with the write clock generated on the basis of the oscillation output from the oscillation circuit 176.

The driver-system control circuit 170 also reads an image for one frame, one scan line at a time, with reference to the scanning latch pulse LP generated on the basis of the oscillation output from the oscillation circuit 176.

The selector circuit 180 has the functions of the selector circuit 64 and the output latch circuit 66 of FIG. 3. The driver-system control circuit 170 includes the above described image determination data generation circuit and generates composite data from one scan line of still-image data that has been read from the display data RAM 24 and one scan line of moving-image data from the line memory 26, in synchronization with the scanning latch pulse LP as the displaying horizontal synchronization signal Hsync.

The PWM decoder circuit 190 latches the composite data for each scan line generated by the selector circuit 180 and outputs a signal of pulse widths corresponding to gray scale values in accordance with the polarity inversion period. The liquid crystal drive circuit 68 supplies the signal from the PWM decoder circuit 190 to the segment electrodes SEG of the liquid crystal panel 22 of FIG. 1, after shifting it to a voltage corresponding to the LCD display voltage.

2. Second Embodiment

The X driver IC 28 of the first embodiment is configured to generate composite data including still-image data and moving-image data for the same scan line, in accordance with image determination data that has been generated based on line and column addresses or on line and column data supplied from the CPU 12 or the controller 14 for each scan line.

An X driver IC in accordance with a second embodiment of the present invention is configured in such a manner that the above described image determination data to which at least corresponding column positions of the display section are linked is stored beforehand in the display data RAM 24. In such a case, it is preferable that this image determination data is previously stored in the display data RAM 24 for each line of the display section.

Figure 10:
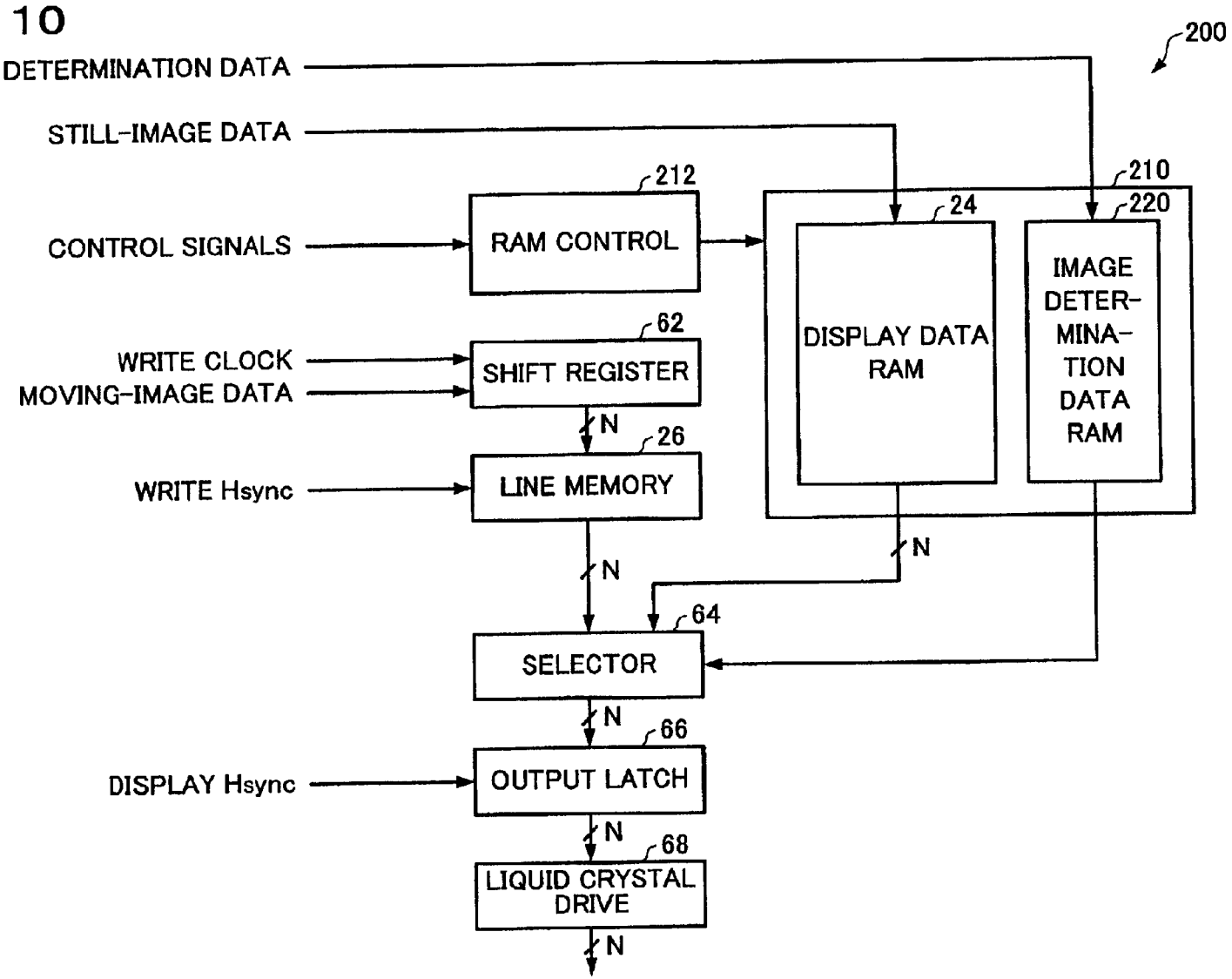
FIG. 10 is a diagram showing an X driver IC acting as a display driver of a second embodiment of the present invention.

An outline of the configuration of an X driver IC that is a display driver in accordance with this second embodiment of the invention is shown in FIG. 10.

Note that components that are the same as those of the X driver IC 28 of FIG. 3 are given the same reference numbers and further description thereof is omitted.

An X driver IC 200 in accordance with this second embodiment comprises at least the display data RAM 24 that stores still-image data for one frame and the line memory 26 that stores moving-image data for one scan line.

The X driver IC 200 of the second embodiment also has a RAM 210 comprising the display data RAM 24, and this RAM 210 also comprises an image determination data RAM 220 where read and write thereof is controlled by the RAM control circuit 212. The image determination data RAM 220 stores image determination data to which at least corresponding column positions are related. This image determination data is stored in the image determination data RAM 220 for each scan line.

The still-image data for one frame is written to the display data RAM 24 by the RAM control circuit 212, based on a display command (control signal) from the CPU 12. The column and scan line positions in the display data RAM 24 correspond to column and line positions of the display section.

The image determination data is written by one bit in scan line units by the RAM control circuit 212 to corresponding to columns of the display data RAM 24, based on the display command (control signal) from the CPU 12. The image determination data for several scan lines are also written at a time by the CPU 12 in correspondence with the scan lines of the display data RAM 24.

Still-image data and image determination data for one scan line of the liquid crystal panel 22 is read from the display data RAM 24 and the image determination data RAM 220 every horizontal scan period of the liquid crystal panel 22.

The selector circuit 64 selects either still-image data that is read from the display data RAM 24 or moving-image data that is read from the line memory 26 for each column position of each scan line, based on the image determination data that has been read from the image determination data RAM 220, and outputs it as composite data of still-image and moving-image data.

The composite data for one scan line that has been selected and output from the selector circuit 64 is latched into the output latch circuit 66 in synchronization with the displaying horizontal synchronization signal Hsync.

The liquid crystal drive circuit 68 supplies the segment electrodes with drive voltages that have been shifted in accordance with the display voltages of the liquid crystal panel 22 of the display unit 20, based on the composite data latched by the output latch circuit 66.

Since the image determination data RAM 220 is provided and image determination data is stored in scan line units by one bit in correspondence with each column, the simultaneous display of moving and still images on the same scan line is enabled.

Figure 11A:
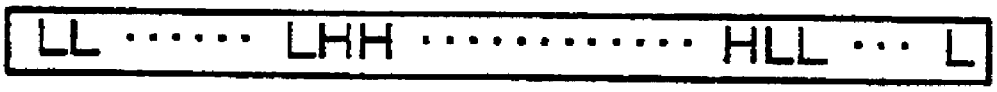
FIG. 11A is illustrative of image determination data for one scan line stored in the image determination data RAM and FIG. 11B is illustrative of image determination data for a number of scan lines stored in the image determination data RAM.
Figure 11B:
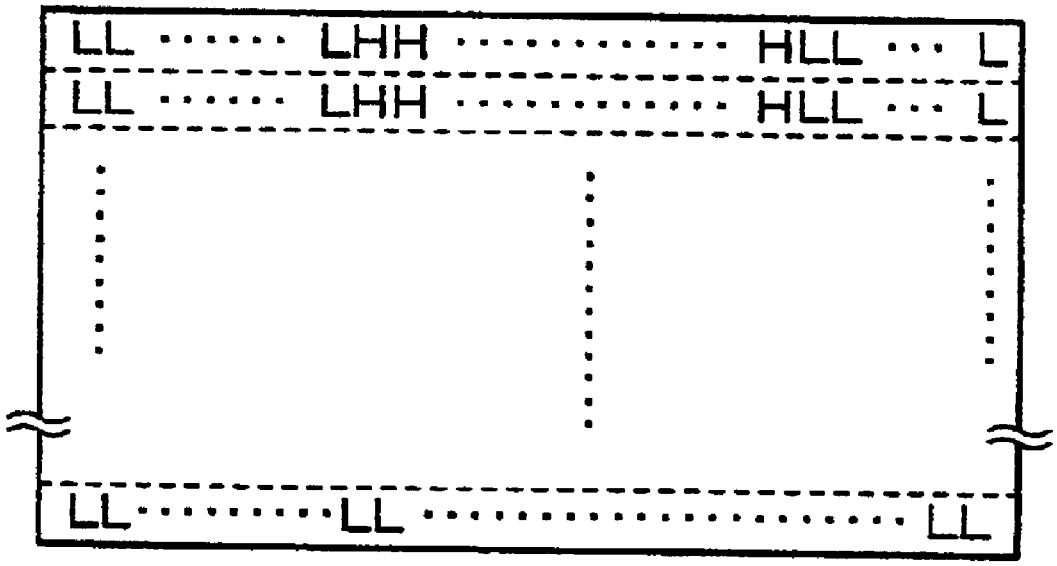

In particular, when only the image determination data corresponding to each column position is stored in the image determination data RAM 220 as shown in FIG. 11A, the configuration is such that image determination data for a number of scan lines can be stored in the image determination data RAM 220 and composite data of still-image and moving-image data can be selected and output every scan period, as described above and shown in FIG. 11B, so that the area in which the moving image is displayed within the still-image display area is not limited to a rectangular shape.

Since there is a tendency for the capacity of the display data RAM to increase with the increasing number of gray scale levels, the above described increase in the number of bits has substantially no effect on the circuit dimensions.

The operation of the X driver IC 200 of this second embodiment is similar to that of the X driver IC 28 of the first embodiment, so further description thereof is omitted.

A detailed structural example of the X driver IC 200 would be similar to that of the first embodiment shown in FIG. 8, except that the image determination data RAM 220 is provided in addition to the display data RAM 24. In other words, the composite data is generated in this second embodiment by having the driver-system control circuit 170 write the image determination data, reading image determination data for one scan line corresponding to still-image data in the display data RAM 24, and having the selector circuit 180 select the data for output.

Note that the present invention is not limited to the embodiments described above, and thus it is possible to devise many modifications thereof within the scope of the invention.

What is claimed is:

1. A display driver which drives a display section based on still-image data and moving-image data, the display driver comprising:

a random access memory (RAM) from which still-image data is read out for each scan line;

a line memory in which is stored moving-image data in scan line units;

a selector which selects and outputs one of a scan line output from the RAM and a line memory output for each column position, based on image determination data;

a line data resister which stores line data indicating whether or not the display section is to be driven based on the moving-image data at each scan line of one column;

a column data register which stores column data indicating whether or not the display section is to be driven based on the moving image data, at each column positlon of one scan line; and a data generation circuit which generates the image determination data based on the line data and the column data, for each column position of one scan line in the display section;

wherein the image determination data is generated according to a column position defining a display area that is driven on the basis of the moving image data or the still-image data, for each scan line.

2. The display driver a defined in claim 1, wherein the image determination data is generated based on:

a column address for specifying a column position defining a display area that is driven on the basis of the moving-image data or the still-image data; and a line address for specifying a position of a scan line defining the display area.

3. A display unit comprising:

a panel having electro-optical elements driven by a plurality of signal electrodes and a plurality of scan electrodes;

the display driver for driving the plurality of signal electrodes as defined in claim 2; and a scan driver for driving the plurality of scan electrodes.

4. An electronic instrument comprising:

the display unit as defined in claim 3, and an image data supply circuit which supplies the still-image data and the moving-image data to the display unit.

5. The display driver as defined in claim 1, wherein:

the RAM relates the image determination data that indicates whether or not the display section is to be driven on the basis of the moving-image data, with at least each column and stores the image determination data; and the selector selects and outputs one of the scan line output from the RAM and the line memory output for each column position, based on the image determination data stored in the RAM.

6. The display driver as defined in claim 5, wherein:

the RAM stores the image determination data for each scan line; and the selector selects and outputs one of the scan line output from the RAM and the line memory output for each column position of each scan line, based on the image determination data stored in the RAM.

7. A display unit comprising:

a panel having electro-optical elements driven by a plurality of signal electrodes and a plurality of scan electrodes;

the display driver for driving the plurality of signal electrodes as defined in claim 6; and a scan driver for driving the plurality of scan electrodes.

8. An electronic instrument comprising:

the display unit as defined in claim 7, and an image data supply circuit which supplies the still-image data and the moving-image data to the display unit.

9. A display unit comprising:

a panel having electro-optical elements driven by a plurality of signal electrodes and a plurality of scan electrodes;

the display driver for driving the plurality of signal electrodes as defined in claim 5; and a scan driver for driving the plurality of scan electrodes.

10. An electronic instrument comprising:

the display unit as defined in claim 9, and an image data supply circuit which supplies the still-image data and the moving-image data to the display unit.

11. A display unit comprising:

a panel having electro-optical elements driven by a plurality of signal electrodes and a plurality of scan electrodes;

the display driver for driving the plurality of signal electrodes as defined in claim 1; and a scan driver for driving tho plurality of scan electrodes.

12. An electronic instrument comprising:

the display unit as defined in claim 11, and an image data supply circuit which supplies the still-image data and the moving-image data to the display unit.

13. A display panel comprising:

electro-optical elements driven by a plurality of signal electrodes and a plurality of scan electrodes; and the display driver that drive the plurality of signal electrodes as defined in claim 1.

14. An electronic instrument comprising:

the display panel as defined in claim 13, and an image data supply circuit which supplies the still-image data and the moving-image data to the display panel.

* * * * *